United States Patent [19]

Sugita et al.

[11] Patent Number: 4,827,985

[45] Date of Patent: May 9, 1989

[54] METHOD OF CONTROLLING PILE WARP TENSION IN SYNCHRONISM WITH LOOM MOVEMENT

[75] Inventors: Katsuhiko Sugita; Akihiko Nakada; Tsutomu Sainen, all of Ishikawa, Japan

[73] Assignee: Tsudakoma Corp., Ishikawa, Japan

[21] Appl. No.: 128,322

[22] Filed: Dec. 3, 1987

[30] Foreign Application Priority Data

Dec. 4, 1986 [JP] Japan ..... 61-289339

[51] Int. Cl.[4] ..... D03D 49/10

[52] U.S. Cl. ..... 139/25; 139/102; 139/110

[58] Field of Search ..... 139/110, 25, 102, 103, 139/26

[56] References Cited

U.S. PATENT DOCUMENTS

| | | | |
|---|---|---|---|
| 3,900,051 | 8/1975 | Bucher | 139/25 |
| 4,293,006 | 10/1981 | Peter | 139/25 |
| 4,513,790 | 4/1985 | Sainen et al. . | |
| 4,569,373 | 2/1986 | Vogel | 139/25 |

FOREIGN PATENT DOCUMENTS 59-133687 9/1984 Japan .

*Primary Examiner*—Andrew M. Falik

*Attorney, Agent, or Firm*—Flynn, Thiel, Boutell & Tanis

[57] ABSTRACT

A warp tension control method by which the let-off motion of a loom is controlled to regulate the tension of the warp yarns. A force of the same dimension as the controlled variable, namely, the tension of the warp yarns, is applied to a mechanism supporting the tension roller of the let-off motion for displacement under the control of an electric control system to control the warp tension at a high accuracy.

8 Claims, 6 Drawing Sheets

METHOD OF CONTROLLING PILE WARP TENSION IN SYNCHRONISM WITH LOOM MOVEMENT

BACKGROUND OF THE INVENTION

1. Field of the Invention:

The present invention relates to a positive let-off motion for a loom and, more particularly, relates to a warp tension control method for accurately controlling warp tension in synchronism with the principal motion of the loom so that warp tension coincides with a target value.

2. Description of the Prior Art

A let-off motion for a loom regulates warp yarn feed rate according to the positional variation of a tension roller over which warp yarns are passed. The warp tension is dependent on a force applied to one end of a tension lever supporting the tension roller at the other end thereof by a mechanical means such as a weight block or a tension spring. Accordingly, a target warp tension can mechanically be determined in a range by using a weight block having an appropriate weight or by using a tension spring having an appropriate spring constant.

Incidentally, the warp tension varies pulsatively in synchronism with the principal motion of the loom during each revolution of the main shaft. Therefore, it is necessary to correct the warp tension properly when the warp tension is increased temporarily by the shedding motion or beating motion of the loom or when the tension of warp yarns on a towel loom needs to be reduced to form warp piles.

An easing motion is disclosed, for example, in Japanese Laid-Open Utility Model Publication No. 59-133687.This easing motion changes the position of a tension roller positively for warp tension to relax the warp tension.

However, in such an easing motion, a corrected warp tension does not necessarily coincide with a target warp tension because the target warp tension is defined by a displacement of the tension roller. That is, since the relation between the actual warp tension and the displacement of the tension roller is dependent on the Young's modulus of the warps, weaving conditions and actual weaving circumstances, and the actual warp tension is not always exactly proportional to the displacement of the tension roller, such a known easing motion is unable to adjust the actual warp tension correctly at a target tension even if the tension roller is displaced by a predetermined displacement. Furthermore, when an occasional warp tension control is required to relax the warp tension only once every several turns of the main shaft of the loom, for example, in forming piles on a pile fabric loom, accurate pile forming operation is impossible because the tension of the pile warp yarns varies more frequently.

Thus, although this prior easing motion may be able to suppress the temporary rise of the warp tension, the easing motion cannot achieve accurate warp tension control operation by any possibility because the controlled variable is not the warp tension, but is the displacement of the tension roller, which is different in dimension from warp tension.

SUMMARY OF THE INVENTION

Accordingly, it is an object of the present invention to control warp tension at a high accuracy, to suppress the temporary rise of warp tension and to set warp yarns at a low tension in forming piles by applying a force having the same dimension as warp tension to a warp tension control system.

According to the present invention, a predetermined force is applied in the direction of action of the resilience of a tension spring in synchronism with the revolution of the main shaft of a loom to increase or reduce the substantial force of action of the tension roller so that the warp tension is adjusted to a target value. The predetermined force is applied as a torque about the axis of rotation of a tension lever by an electromechanical transducing means such as an AC servomotor or a torque motor. Consequently, the warp tension balances the sum of the resilience of the tension spring and the predetermined force and thereby the warp tension is adjusted to the target value.

Accordingly, even if the Young's modulus of the warp yarns varies temporarily or even if the weaving circumstances vary during the warp tension control process, the warp tension is adjusted to the target value because the warp tension coincides always with the resultant force of the resilience of the tension spring and the predetermined force counteracting in the direction of variation of the resilience of the tension spring. When the predetermined force includes the resilience of the tension spring, the tension spring need not necessarily be provided.

Furthermore, when pile warp yarns must be fed at a high feed rate and at a low warp tension only once every several turns of the main shaft of the loom such as in feeding pile warp yarns on a towel loom, the inertia of the tension roller is a problem in stopping and in moving the tension roller. The present invention is also capable of effectively suppressing the temporary variation of warp tension due to the inertia of the tension roller.

The present invention controls warp tension at a high accuracy by applying force balancing warp tension to a tension roller supported for movement, in synchronism with the principal motion of a loom. Since the conventional warp tension control system controls warp tension through the control of the displacement of the tension roller, it is difficult to adjust warp tension accurately at a target tension when the correlation of the displacement of the tension roller with warp tension is unstable due to the elongation of warp yarns and the variation of external conditions affecting the weaving operation of the loom. However, the present invention is able to carry out accurate warp tension control because, as mentioned above, the present invention uses a force having the same dimension as warp tension as a manipulated value. Accordingly, the present invention is able to deal with the variation of warp tension in each weaving cycle of the loom, which could not have been dealt with by the conventional warp tension control method, and is able to control warp tension minutely for forming piles on a pile fabric loom to achieve advanced control of warp tension and to prevent faulty piles.

DESCRIPTION OF THE PREFERRED EMBODIMENTS

Constitution and Function of a Let-off Control System

Figure 1:
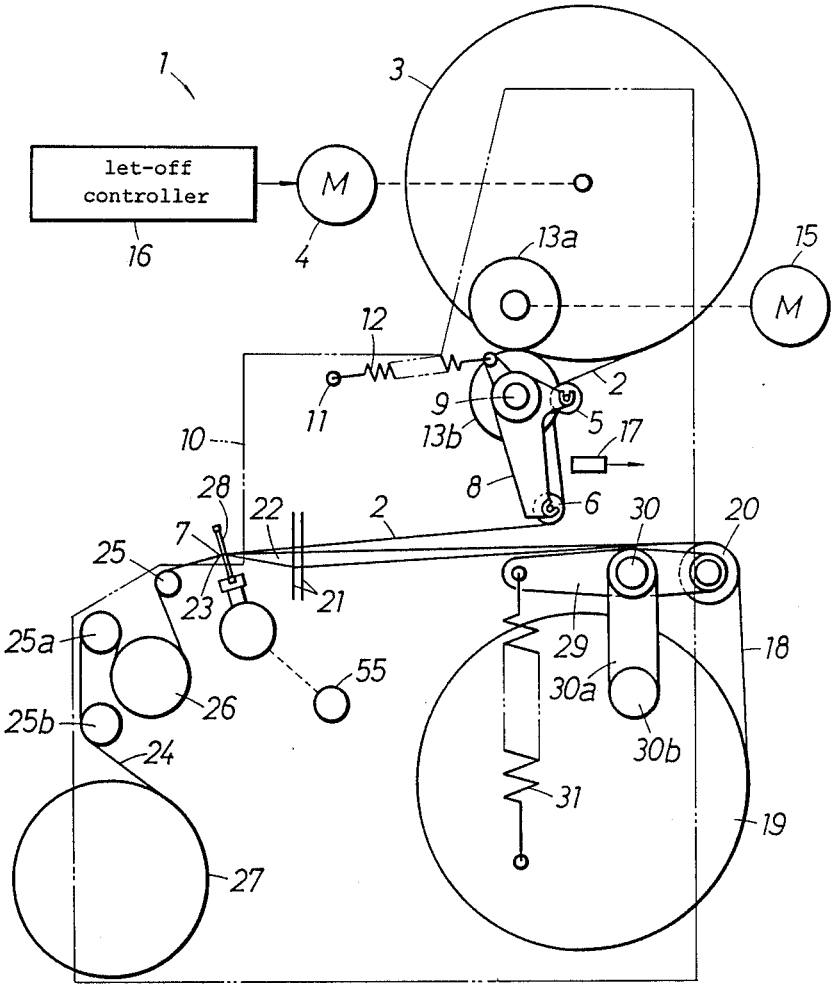
FIG. 1 is a diagrammatic side elevation of a let-off motion.
Figure 2:
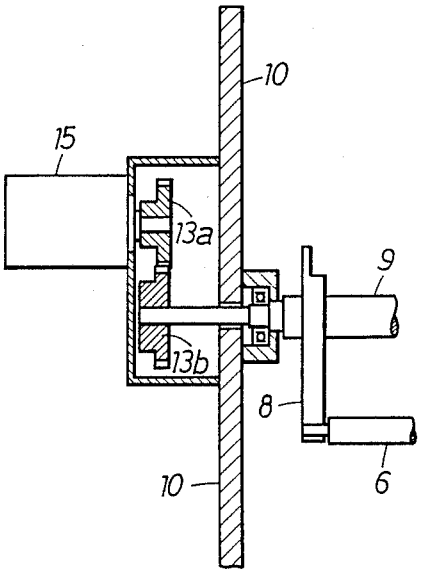
FIG. 2 is a sectional view of a portion of a torque transmission mechanism.
Figure 3:
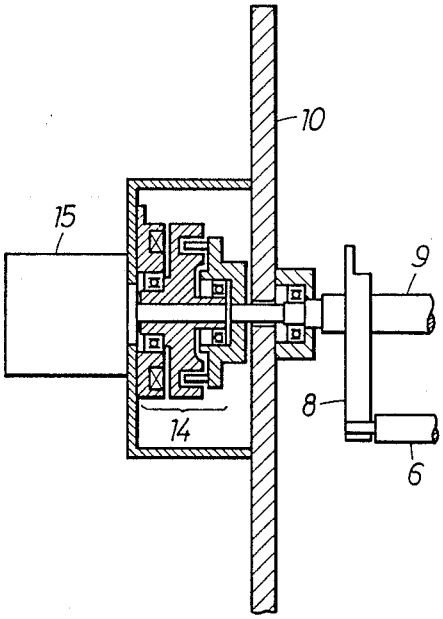
FIG. 3 is a sectional view of an electromagnetic clutch.

FIG. 1 shows a let-off motion 1 for carrying out a warp tension control method of the present invention, applied to letting off warp pile yarns 2. Many parallel warp pile yarns 2 are wound in a pile warp beam 3 having a weaving width on a warping beam. The pile warp beam 3 is rotated through gears by a let-off motor 4 to let off the pile warp yarns 2 positively. The pile warp yarns which are thus let off from beam 3 move over a roller 5 and a tension roller 6 toward a cloth fell 7. The guide roller 5 and the tension roller 6 are supported rotatably on a tension lever 8. The tension lever 8 is fixedly mounted for swing motion on a pivot shaft 9 at a fixed position on a frame 10. A tension spring 12 is extended between one end of the tension lever 8 and a spring retainer 11 fixed to the frame 10 to urge the tension lever 8 continually in a direction to apply a tension to the pile warp yarns 2. The pivot shaft 9 is driven rotatively by an electromechanical transducing means, for example, an AC servomotor 15, through gears 13*a* and 13*b* as shown in FIG. 2 or through a gap type electromagnetic clutch 14 as shown in FIG. 3. Naturally, the output shaft of the AC servomotor 15 can rotate in opposite directions, and the AC servomotor 15 generates continually a torque proportional to current supplied thereto even while the output shaft thereof is stopped.

The let-off motor 4 is controlled by a let-off controller 16. The let-off controller 16 measures the consumption of the pile warp yarns 2 indirectly through the detection of the displacement of the tension lever 8 by a displacement detector 17, and drives the let-off motor 4 so as to rotate the pile warp beam 3 in the let-off direction according to the consumption of the pile warp yarn detected by the displacement detector 17 to let-off the pile warp yarns 2. The let-off controller 16 is of a feedback system having a large time constant or in other words a relatively long response time, and hence the temporary displacement of the tension roller 6 in the shedding motion or in the pile forming operation of the loom is not the objective controlled variable of the let-off controller 16. The details of the constitution of the let-off controller 16 will be described afterward with reference to FIG. 4.

Ground warp yarns 18 are wound in a ground warp beam 19. The ground warp yarns 18 are extended over a tension roller 20. The ground warp yarns 18 are controlled by the vertical motion of healds 21 to form a shed 22. A weft yarn 23 is picked into the shed 22 and interlaced with the ground warp yarns 18, then the picked weft yarn 23 is beaten by a reed 28 to form the ground texture of a fabric 24. The fabric 24 is taken up through a cloth roller 25 capable of moving toward and away from the cloth fell 7, a surface roller 26 and guide rollers 25*a* and 25*b* and is wound on a cloth roller in a cloth beam 27. The tension roller 20 is supported rotatably on a tension lever 29 swingably supported on a pivot shaft 30. The tension lever 29 is urged by a tension spring 31 in a direction to apply a predetermined tension to the ground warp yarns 18. The pivot shaft 30 is supported on one end of a supporting arm 30*a* which is supported for swing motion by a shaft 30*b* on the frame 10. The supporting arm 30*a* and the cloth roller 25 are moved to the front for terry motion in synchronism with the beating motion of the loom, for example, by a positive motion cam mechanism to move the cloth fell 7 to the front by an appropriate distance from the beating position, namely, a distance corresponding to a length for forming a pile.

The ground warp beam 19, the surface roller 26 and the cloth beam 27 are driven rotatively by conventional means such as an electric motor or motors, or a mechanical let-off mechanism and mechanical take-up mechanisms, respectively.

As the loom continues the weaving operation, the pile warp yarns 2 are pulled gradually to the front by the fabric 24 and thereby the tension of the pile warp yarns 2 increases gradually and the tension lever 8 is caused to turn clockwise, as viewed in FIG. 1, accordingly against the spring force of the tension spring 12. The displacement detector 17 detects the angular displacement of the tension lever 8 and gives an electric signal corresponding to the angular displacement of the tension lever 8 to the let-off controller 16. Then, the let-off controller 16 drives the let-off motor 4 to rotate the pile warp beam 3 positively in the direction to let-off the pile warp yarns 2 for maintaining the tension of the pile warp yarns so that the cloth fell 7 is maintained always at a predetermined position. Similarly, the ground warp yarns 18 are let off by positive let-off motion.

Pile Warp Yarn Let-off Rate

In weaving a pile fabric such as a three-filling terry cloth, three weft yarns are picked to form one complete weave, namely, the crankshaft 55 of the loom rotates three turns to form one complete weave. In a loom employing a moving cloth type terry motion as shown in FIG. 1, the pile warp yarns 2 are let off at a low tension by a length necessary for forming piles in a period between a beating motion for forming the piles and the subsequent beating motion, and the pile warp yarns 2 need to be drawn back at a low tension in a period between the beating motion for forming piles and the preceding beating motion. On the other hand, in a loom employing a variable beating motion type terry motion, the first and second picks are followed by normal beating motion whereas the third pick is followed by a special beating motion, namely, so-called terry motion, in which the pile warp yarns 2 must be let off rapidly by a length necessary for forming piles.

Pile warp yarn let-off rate at which the pile warps 2 are let off is expressed by $$v = 2\pi R(\omega/60)(\text{mm/sec}) \quad (1)$$

where $\omega$(rpm) is the rotating speed of the pile warp beam 3, R (mm) is the radius of the pile warp beam 3, and v (mm/sec) is the circumferential speed of the pile warp beam 3.

On the other hand, when pick spacing for the weft yarns 23 is B (picks/cm), a let-off length for each pick is 10/B (mm). Therefore, a warp let-off length necessary for three picks is expressed by $$L=3\times 10/B+d \quad (2)$$

where L (mm) is warp let-off length for three picks, and d (mm) is a reed clearance, namely, a length of each pile warp yarn 2 necessary for forming a pile.

Since a time necessary for three picks is $3\times(60/n)$(sec), where n (rpm) is the rotating speed of the crankshaft 55 of the loom, $$v=L/(180/n)=(n/180)(30/B+d) \quad (3)$$

Substituting expressions (1) and (2) into expression (3), we obtain $$\omega=(60/2\pi R)(n/180)(30/B+d)=(n/6\pi R)(30/B+d) \quad (4)$$

The required rotating speed $N_0$ of the let-off motor 4 is expressed by $$N_0=m\ \omega=m/6\pi\cdot n/R(30/B+d) \quad (5)$$

where m is the gear ratio of a transmission mechanism interlocking the let-off motor 4 and the pile warp beam 3. This expression is a basic expression for calculating the rotating speed of the let-off motor 4 for driving the pile warp beam 3. Since the gear ratio m is intrinsic to the system, the basic rotating speed $N_0$ of the let-off motor 4 can be determined through calculation when the radius R of the pile warp beam 3, the rotating speed n of the crankshaft 55 of the loom, the pick spacing B and the reed clearance d are given.

Figure 4:
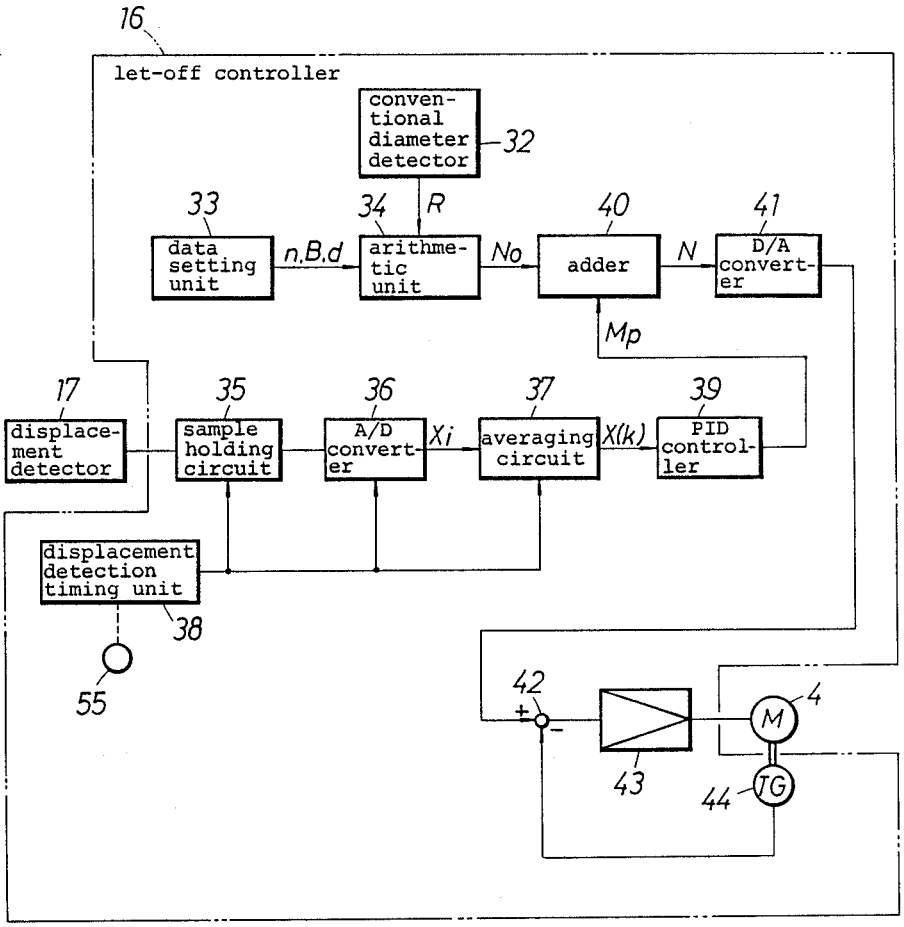
FIG. 4 is a block diagram of a let-off motion controller.

Referring to FIG. 4 showing the let-off controller 16, input data, namely, respective predetermined values for the parameters of expression (5), namely, the rotating speed n of the crankshaft 55, the pick spacing B and the reed clearance d, are given to an arithmetic unit 34 by operating a data setting unit 33. A conventional diameter detector 32 continually detects the radius R of the pile warp beam 3 and gives data representing the radius R of the pile warp beam 3 to the arithmetic unit 34. The arithmetic unit 34 operates the input data by using expression (5) and provides a digital value representing the basic rotating speed $N_0$ of the let-off motor 4.

The basic expression (5) is modified by a term including the output Mp of an automatic control system to determine a final rotating speed N (rpm) by $$N=(m/6\pi)(n/R)(30/B+d)(1+Mp/100) \quad (6)$$

where r is number of sampling per one rotation of the loom, Mp is a PID output obtained by averaging 3r pieces of measured values $x_i$ of displacement of the tension lever 8 obtained by sampling the position of the tension lever 8 every fixed angular interval during three turns of the crankshaft 55. As stated in U.S. Pat. No. 4,513,790, $$Mp=\left[Kp\,X(k)+1/Ti\cdot\sum_{m=0}^{k}x(m)+td\{X(k)-x(k-1)\}\right] \quad (7)$$

$$X(k)=1/3r\cdot\sum_{i=1}^{3r}Xi \quad (8)$$

Referring again to FIG. 4, a sample holding circuit 35 holds the output of a displacement detector 17. An A/D converter 36 converts the analog output of the displacement detector 17 into corresponding digital signals Xi. An averaging circuit 37 averages the k pieces of digital signals Xi to provide a mean value X(k). A displacement detection timing unit 38 controls a series of steps of sampling and averaging operation to obtain a mean value X(k) for a predetermined angle of rotation of the crankshaft 55 of the loom. A PID controller 39 processes the mean values X(k) through a proportional plus integral plus derivative action to provide an output Mp. An adder 40 provides a digital command signal representing a required rotating speed N. The digital command signal is converted into an analog signal by an D/A converter 41, the analog signal is applied to an add point 42, the analog signal is amplified by a driving amplifier 43 to provide a DC driving signal for driving the let-off motor 4. The rotating speed of the let-off motor 4 is detected by a tachometer generator 44 of the feedback control system and the detected rotating speed of the let-off motor 4 is fed back to the add point 42.

Control of the Tension Roller

Figure 5:
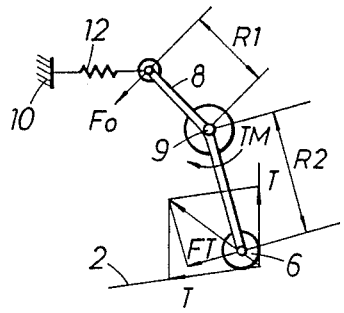
FIG. 5 is a diagrammatic illustration of assistance in explaining the action of a moment of a force on a tension lever.

Referring to FIG. 5, suppose that the component of the total tension T of the pile warp yarns 2 acting perpendicularly to the tension lever 8 is Fr, and the component of the spring force of the tension spring 12 acting perpendicularly to the tension lever 8 is Fo. Then, $$R1\cdot F_0=R2\cdot Fr=k\cdot\alpha x \quad (9)$$

where $\alpha$ is a coefficient representing the effective component of the spring force of the tension spring 12 perpendicular to the tension lever 8, k is the spring constant of the tension spring 12, x is the extension of the tension spring 12, R1 is the effective length from the center axis of the pivot shaft 9 to the point of action of Fo of the tension spring 12, and R2 is the effective length from the center axis of the pivot shaft 9 to the point of action of Fr of the total tension T of the pile warp yarns 2. The tension of the pile warp yarns 2 is controlled through feedback control according to the output signal of the displacement detector 17 at a fixed low tension T meeting expression (9).

Moving the cloth roller 25 to the front causes the extension x of the tension spring 12 to increase by an increment $\Delta x$. Then, $$R1\cdot k\alpha(x+\Delta x)=R2(Fr+\Delta Fr) \quad (10)$$

Therefore, $$\Delta Fr=(R1/R2)k\alpha\Delta x \quad (11)$$

Consequently, it is possible that faulty pile formation occurs due to increase in the tension T of the pile warp yarns 2.

To avoid faulty pile formation, the AC servomotor 15 applies a torque $T_M$ to the tension lever 8 to turn the tension lever 8 clockwise as viewed in FIG. 5 so that the tension roller 6 is moved to the front. Then, $$R1\cdot k\ \alpha(x+\Delta x)=R2(Fr+\Delta Fr)+T_M$$

and hence $$\Delta Fr=(1/R2)(R1\cdot k\alpha\cdot\Delta x-T_M) \quad (12)$$

Accordingly, when $T_M = R1 \cdot k \cdot \Delta x$, $\Delta Fr = 0$ and thereby increase in the tension T of the pile warp yarns 2 is avoided. It is also possible to avoid faulty pile formation surely by reducing the tension T of the pile warp yarns 2 by applying a torque $T_M > R1 \cdot k \cdot \alpha x$ to the tension lever 8 to make $\Delta Fr < 0$.

Suppose that the apparent spring constant of the tension spring 12 is K. Then, $$R1 \cdot K\alpha(x + \Delta x) = R2 \cdot Fr = R1 \cdot k\alpha x$$

Therefore, $$K = k(1/(1 + \Delta x/x)) \quad (13)$$

As obvious from expression (13) the apparent spring constant K is smaller than the spring constant k.

Cancellation of the Inertia of the Tension Roller

Thus, the cloth roller 25 rocks to the front and to the back in synchronism with the weaving operation of the loom. When the cloth roller 25 is moved to the back, the tension roller 6 is moved back accordingly. When the mechanism supporting the tension roller 6 has a large inertia, the backward movement of the tension roller 6 is delayed relative to the backward movement of the cloth roller 25, so that the pile warp yarns 2 and the ground warp yarns 18 are relaxed excessively causing faulty shedding to make picking impossible. To avoid the excessive relaxation of the pile warp yarns 2 and the ground warp yarns 18, the output shaft of the AC servomotor 15 is turned temporarily in the reverse direction to apply a reverse torque to the tension lever 8 to increase the apparent spring force of the tension spring 12 at a high response speed to avoid the excessive reduction of the tension of the pile warp yarns 2 and the ground warp yarns 18. Thus, the adverse influence of the inertial of the tension roller supporting system on the tension control operation can be canceled.

If the tension roller 6 overruns beyond the back limit position due to the inertia thereof, the tension T increases excessively which can make uniform pile formation impossible. To avoid such an adverse movement of the tension roller 6, the output shaft of the AC servomotor may be driven temporarily in the normal direction to apply a torque to the tension lever 8 in the let-off direction so that the apparent spring force of the tension spring 12 is reduced at a high response speed to maintain the tension T on an appropriate level.

Figure 6:
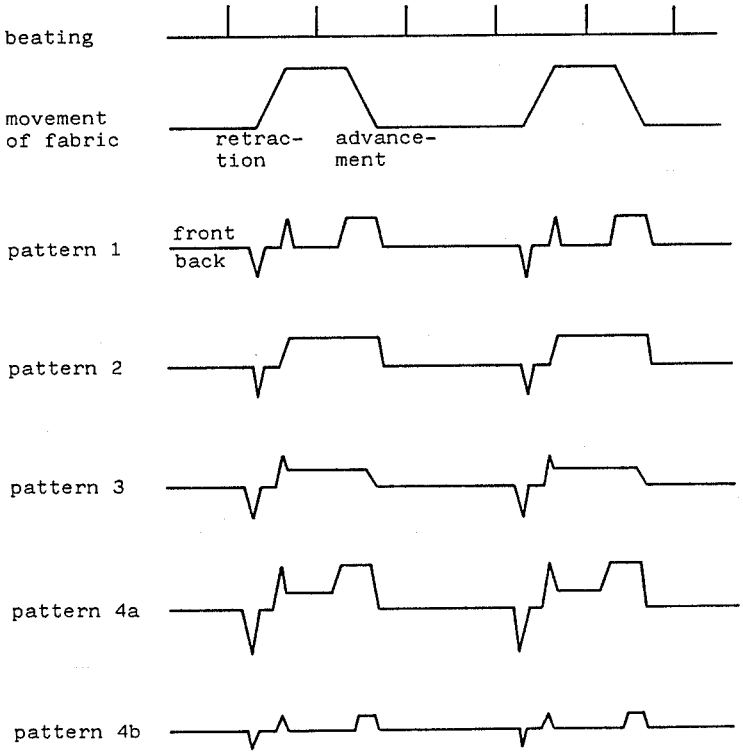
FIG. 6 is a diagram of assistance in explaining various possible modes of driving the tension lever.

FIG. 6 shows various AC servomotor driving modes in relation with the beating motion and the movement of the fabric 24. When the fabric 24 is moved to the back, the AC servomotor 15 is driven so that the cloth fell 7 moves to the back, and is driven after the end of the movement of the cloth fell 7 to the back so that the cloth fell 7 moves to the front. When the fabric 24 moves to the front from the backmost position, the AC servomotor 15 is driven so that the cloth fell 7 moves continuously or intermittently to the front. Such AC servomotor driving modes 1, 2, 3, 4*a* and 4*b* are determined properly taking the type of the pile warp yarns 2, the distance of movement of the cloth fell 7 and the inertia of the tension roller 6 into consideration. Although the tension of the pile warp yarns 2 is subject to complex causes of tension variation of different phases such as the shedding motion, the beating motion, the movement of the fabric 24 and the inertia of the mechanical system, the tension variation attributable to such causes can be cancelled by driving the AC servomotor 15 in an appropriate AC servomotor driving mode.

During the weaving operation for the ground texture, the cloth fell 7 is not moved and hence the control of the movement of the tension roller 6 for positive tension control is interrupted.

When the rotative force of the AC servomotor 15 is transmitted through the gears 13*a* and 13*b* to the pivot shaft 9 as shown in FIG. 2, the mass of the mechanical system for moving the tension roller 5 is comparatively large. When a gap type electromagnetic clutch 14 is employed for transmitting the rotative force of the AC servomotor 15 to the pivot shaft 9 as shown in FIG. 3, the mass of the mechanical system for moving the roller 6 is comparatively small, which is advantageous in respect of eliminating the adverse influence of the inertia of the mechanical system on the control of the tension.

Figure 7:
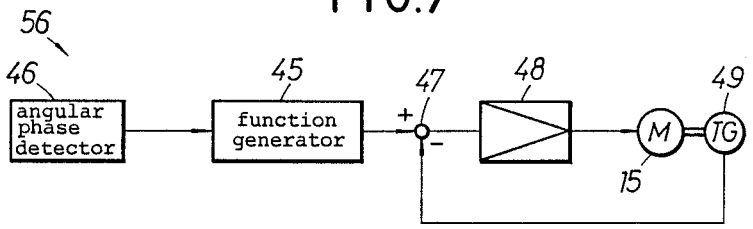
FIGS. 7 to 11 are block diagrams of tension controllers.

First Embodiment (FIG. 7)

The first embodiment of the present invention employs a tension controller 56 for driving the AC servomotor 15, namely, the electromechanical transducing means, in a predetermined driving mode. A function generator 45 stores a predetermined driving pattern. An angular phase detector 46 detects the angular phase of the crankshaft 55 of the loom. The function generator 45 gives output signals in accordance with the driving pattern in synchronism with the phase angle of the crankshaft 55 detected by the phase angle detector 46 through an add or summing device 47 to a driving amplifier 48. The driving amplifier 48 drives the AC servomotor 15 according to the input signals. On the other hand, a tachometer generator 49 detects the rotating speed of the AC servomotor 15 and applies an electric signal representing the rotating speed of the AC servomotor 15 to an add point 47 in a feedback mode. Thus, the driving amplifier 48 controls the torque $T_M$ of the AC servomotor 15 according to a driving pattern specified by the function generator 45 in synchronism with the rotation of the crankshaft 55 of the loom.

Figure 8:
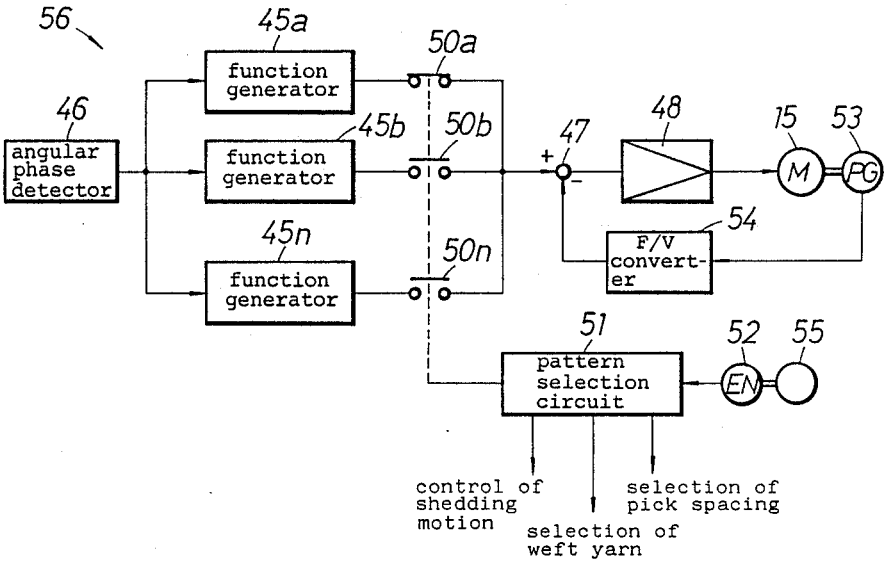

Second Embodiment (FIG. 8)

The second embodiment employs a plurality of function generators 45*a*, 45*b*, . . . and 45*n* respectively storing a plurality of driving patterns and respectively having contacts 50*a*, 50*b* . . . and 50*n* connected to an add point 47. The contacts 50*a*, 50*b*, . . . and 50*n* are closed selectively by a pattern selection circuit 51 to apply the driving patterns selectively to the add point 47. The pattern selection circuit 51 selects one of the plurality of function generators 45*a*, 45*b*, . . . and 45*n* on the basis of an output signal of a shaft encoder 52 associated with the crankshaft of the loom. On the other hand, the pattern selection circuit 51 executes control operation for controlling the shedding motion, the selection of weft yarns 23 and the selection of pick spacing B. A pulse generator 53 detects the rotating speed of the AC servomotor 15 and gives a pulse signal corresponding to the rotating speed of the AC pulse motor 15 to a F/V converter 54. The F/V converter converts the output pulse signal of the pulse generator 53 into a voltage signal proportional to the frequency of the output pulse signal of the pulse generator 53 and applies the voltage signal to the add point 47 for feedback control.

Figure 9:
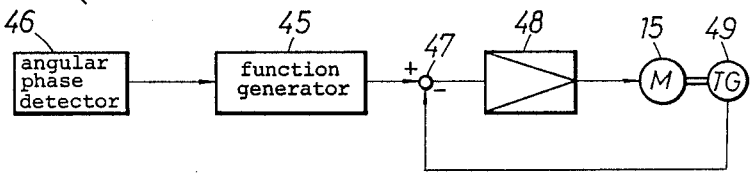

Third Embodiment (FIG. 9)

Basically, the third embodiment is the same as the first embodiment. In the third embodiment, the reversible rotation of the output shaft of the AC servomotor 15 (electromechanical transducing means) is controlled by giving a command for rotation in the normal direction or a command for rotation in the reverse direction to a driving amplifier 48. It is possible to apply a torque $T_M$ to the pivot shaft 9 in opposite directions by connecting two rotative driving sources each capable of rotating a driven member only in one direction through gap type electromagnetic clutches 14 to the opposite ends of the pivot shaft 9, respectively, and selectively activating the rotative driving sources.

Figure 10:
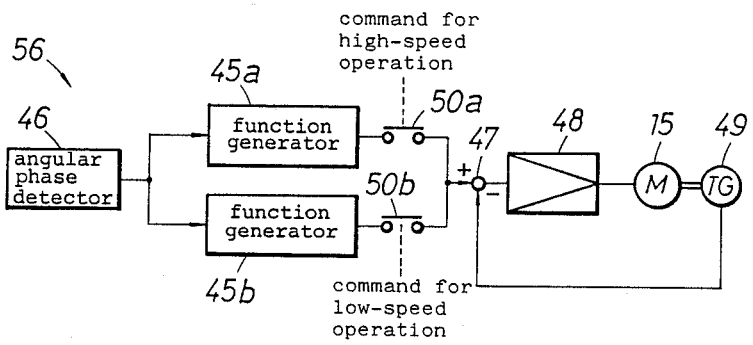

Fourth Embodiment (FIG. 10)

In the fourth embodiment, one of a plurality of driving patterns is selected according to the rotating speed of the crankshaft 55. That is, either a contact 50*a* or 50*b* is closed selectively depending on the weaving speed of the loom, namely, high weaving speed or low weaving speed, to select the driving pattern 4*a* or 4*b* (FIG. 6) depending on the weaving speed of the loom.

Figure 11:
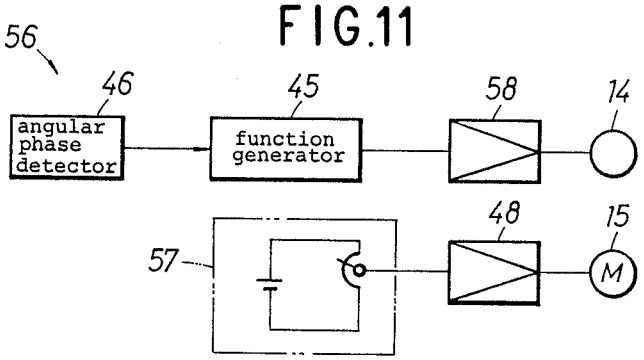

Fifth Embodiment (FIG. 11)

In the fifth embodiment, a fixed voltage is applied to the AC servomotor 15 through a driving amplifier 48 by a constant-voltage power supply 57, while the gap type electromagnetic clutch 14 is driven by a function generator 45. The function generator 45 drives a driving amplifier 58 according to the angular phase of the crankshaft 55 detected by an angular phase detector 46 to vary the torque transmission capacity of the electromagnetic clutch 14. Accordingly, the torque $T_M$ to be transmitted to the pivot shaft 9 is varied according to a driving pattern while the output torque of the AC servomotor 15 is constant.

Other Embodiments

Figure 12:
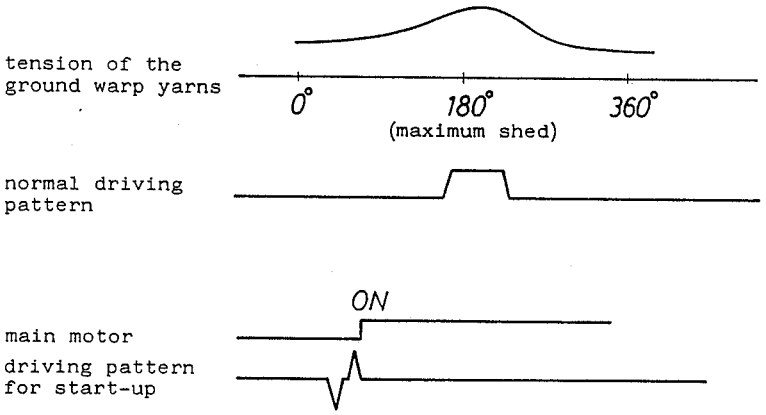
FIG. 12 is a diagram of assistance in explaining a mode of driving the let-off motion of a loom.

Although the present invention has been described as applied to controlling the tension of the pile warp yarns 2, the present invention is applicable also to controlling the tension of the ground warp yarns 18 and to controlling the tension of warps on ordinary looms. FIG. 12 shows the relation between the variation of the tension of the ground warp yarns 18 in one weaving cycle, namely, in one turn of the crankshaft 55 of the loom, and driving patterns. In starting the loom, the AC servomotor 15 is driven by a driving pattern for driving the AC servomotor 15 alternately in opposite directions in synchronism with a kickback motion to prevent a stop mark.

Although the tension roller 6 is supported for swing motion by the tension lever 8 in the foregoing embodiments, the tension roller 6 may be supported for linear movement and the tension roller 6 may be moved linearly by an electromechanical transducing means capable of generating a linear driving force.

As mentioned above, when an electromechanical transducing means capable of performing the agency of the tension spring 12 is used, the tension spring 12 may be omitted.

What is claimed is:

1. A warp tension control method for controlling a let-off motion for a loom which has rotatable crankshaft and has a displaceable tension roller over which warp yarns from a rotatable warp beam are extended, comprising the steps of applying a force to the tension roller in a direction of displacement of the tension roller so that the tension of the warp yarns is maintained substantially on a fixed level, rotating the warp beam in a let-off direction at a speed varied in dependence on the amount of displacement of the tension roller, and applying to the tension roller a force which is varied in a predetermined manner in synchronism with the rotation of the crankshaft of the loom to regulate the position of the tension roller so that the tension of the warp yarn is adjusted substantially to a target value.

2. A warp tension control method according to claim 1, wherein said step of applying said force varied in synchronism with rotation of the crankshaft is carried out using an electromechanical transducing means which is operatively coupled to said tension roller and is controlled by an electric control signal.

3. A warp tension control method according to claim 2, including the step of selecting said control signal from a plurality of electric signals having respective different patterns.

4. A warp tension control method according to claim 3, wherein one of the electric signals has a pattern which controls the movement of the tension roller while the loom is operated at a low weaving speed for preparatory operation.

5. A warp tension control method according to claim 3, wherein one of said electric signals has a pattern which drives said electromechanical transducing means so as to cancel the inertia of the tension roller.

6. A warp tension control method according to claim 4, wherein the tension roller is rotatably supported on a pivotally supported support, and wherein said transducing means includes a constant-speed motor and a gap type electromagnetic clutch which transmits a torque from said motor of said electromechanical transducing means to said support pivotally supporting the tension roller.

7. A warp tension control method according to claim 2, wherein the tension roller is rotatably supported on a support which is connected to and extends radially from a rotatable pivot shaft, and wherein said step of applying said force varied in synchronism with rotation of the crankshaft includes the step of causing said electromechanical transducing means to apply a rotational torque to the pivot shaft.

8. A warp tension control method according to claim 5, wherein said electromechanical transducing means includes a servomotor having an output shaft drivingly coupled to said pivot shaft, and wherein said step of causing said transducing means to apply a rotational torque is carried out by the step of selectively supplying currents of opposite directions to the servomotor to urge rotation of the output shaft of the servomotor selectively in opposite directions.

* * * * *

UNITED STATES PATENT AND TRADEMARK OFFICE

CERTIFICATE OF CORRECTION

PATENT NO. : 4 827 985

DATED : May 9, 1989

INVENTOR(S) : Katsuhiko Sugita et al

It is certified that error appears in the above-identified patent and that said Letters Patent is hereby corrected as shown below:

Column 10, line 55; change "5" to ---7---.

Signed and Sealed this

Twenty-second Day of May, 1990

*Attest:*

*Attesting Officer*

HARRY F. MANBECK, JR.

*Commissioner of Patents and Trademarks*